United States Patent [19]

Powers et al.

[11] 4,440,606

[45] Apr. 3, 1984

[54] METHOD FOR PRODUCING A SOLAR SELECTIVE COATING ON ALUMINUM

[75] Inventors: John H. Powers, Lower Burrell; Hang T. Dang, Pittsburgh, both of Pa.

[73] Assignee: Aluminum Company of America, Pittsburgh, Pa.

[21] Appl. No.: 409,067

[22] Filed: Aug. 18, 1982

[51] Int. Cl.[3] ..... C25D 11/22

[52] U.S. Cl. ..... 204/33; 204/35 N; 204/42; 126/901

[58] Field of Search ..... 204/35 N, 33, 38 A, 204/42; 126/901

[56] References Cited

U.S. PATENT DOCUMENTS

| | | | |
|---|---|---|---|
| 3,382,160 | 5/1968 | Asada | 204/35 |
| 3,791,940 | 2/1974 | Alexander | 204/35 N |
| 3,897,287 | 7/1975 | Meyer et al. | 156/22 |
| 4,022,671 | 5/1977 | Asada | 204/42 |

FOREIGN PATENT DOCUMENTS

| | | | |
|---|---|---|---|
| 55-72763 | 5/1980 | Japan | 126/901 |
| 55-44159 | 11/1980 | Japan | 204/35 N |

OTHER PUBLICATIONS

A. Andersson et al., Nickel Pigmented Anodic Aluminum Oxide . . . , American Institute of Physics, 1979.

W. E. Hubner, The Practical Anodizing of Aluminum, McDonald and Evans, London, 1960, pp. 62–63.

J. D. Edwards, Anodic Coating of Aluminum, Aluminum Company of America, 1939, pp. 14–17.

*Primary Examiner*—Winston A. Douglas
*Assistant Examiner*—William Leader
*Attorney, Agent, or Firm*—Andrew Alexander

[57] ABSTRACT

An improved process for producing a solar selective coating on aluminum comprises a preliminary treatment such as an etch or brightening followed by anodizing in phosphoric acid at a constant voltage of from 10–20 volts for a time period sufficient to provide a total current of from 90–175 coulombs per square decimeter of aluminum surface. Prior to sealing, the resultant anodized surface is subjected to a constant AC voltage coloring treatment in a concentrated metal sulfate solution containing at least 85 grams per liter of metal sulfates.

22 Claims, 1 Drawing Figure

METHOD FOR PRODUCING A SOLAR SELECTIVE COATING ON ALUMINUM

BACKGROUND OF THE INVENTION

This invention relates to a process for producing a coating on aluminum, and more particularly, for producing a solar selective coating.

Aluminum has been anodized in the past both to protect the substrate against corrosion as well as to provide an aesthetically pleasing surface suitable for indoor or outdoor uses without further covering or coating. Most notable of such applications is the use of anodized aluminum, both natural and colored, on the outer curtain walls of buildings. For such applications, it has become conventional to provide thick anodized coatings, i.e. as much as 15 microns or more, on the aluminum surface. The porous coating is then sealed using processes well known to those skilled in the art.

In more recent years, the search for a broader and more pleasing range of colors has lead to the insertion of an AC coloring step between the anodizing and sealing steps using various metal salts, typically metal sulfates. Such a process is described in Asada U.S. Pat. No. 3,382,160. An improvement on this process, as described in Asada U.S. Pat. No. 4,022,671, inserts an electrolytic processing step in phosphoric acid subsequent to the sulfuric acid anodizing and prior to the electrocoloring.

While such processes have yielded interesting products for architectural uses, coatings produced by such processes have not been found useful in the production of solar selective coatings. Because of the emphasis on energy conservation and energy sources, considerable interest has been shown in the production of solar coatings. Apparently, the lack of solar selectivity, i.e. high absorption and low emittance, is due to the thickness of the coating produced by these processes.

French Demande No. 2,360,051, entitled "Solar Heat Collector Containing a Coating Selectivity Absorbing Solar Heat Energy", by Showa Aluminium K.K., describes a process for producing a solar selective coating on aluminum using phosphoric acid anodizing followed by AC electrocoloring. While materials produced by this process are reported to exhibit excellent optical properties, the anodizing times of 15 to 20 minutes reported using 15 to 20% $H_3PO_4$ make the process economically impractical for continuous anodizing of coil where it is desirable to have much shorter residence time in the anodizing bath. The AC electrocoloring step is also reported as a 15 to 20 minute step, depending upon the particular metal salts used. The process is described as being carried out under constant current conditions of 1 to 1.5 amperes per square decimeter.

SUMMARY OF THE INVENTION

It is an object of the invention to provide an economical process for the production of a solar selective coating on aluminum.

It is another object of the invention to provide a process to produce a solar selective coating on aluminum using a constant anodizing voltage.

It is yet another object of the invention to provide a solar selective coating characterized by a coating thickness of less than 1 micron, a solar spectrum absorptance of at least 91% and an infrared emittance of not more than 18%.

It is a further object of the invention to provide a process for the production of a solar selective coating on aluminum which can be carried out as a continuous process.

These and other objects of the invention will be apparent from the description of the invention.

In accordance with the invention, a solar selective coating characterized by a coating thickness of less than 1 micron, a solar spectrum absorptance of at least 91% and an infrared emittance of not more than 18% is produced on aluminum by anodizing previously etched or chemically brightened aluminum at a constant voltage of at least 10 volts in a phosphoric acid anodizing bath for a time sufficient to provide a total anodizing current of from 90 to 175 coulombs per square decimeter. The anodized aluminum is then colored in a metal sulfate bath at about 10 volts AC for a period sufficient to provide a total current flow of from 100 to 325 coulombs per square decimeter.

BRIEF DESCRIPTION OF THE DRAWINGS

The sole drawing is a flow sheet illustrating the process of the invention.

DETAILED DESCRIPTION OF THE INVENTION

Figure 1:
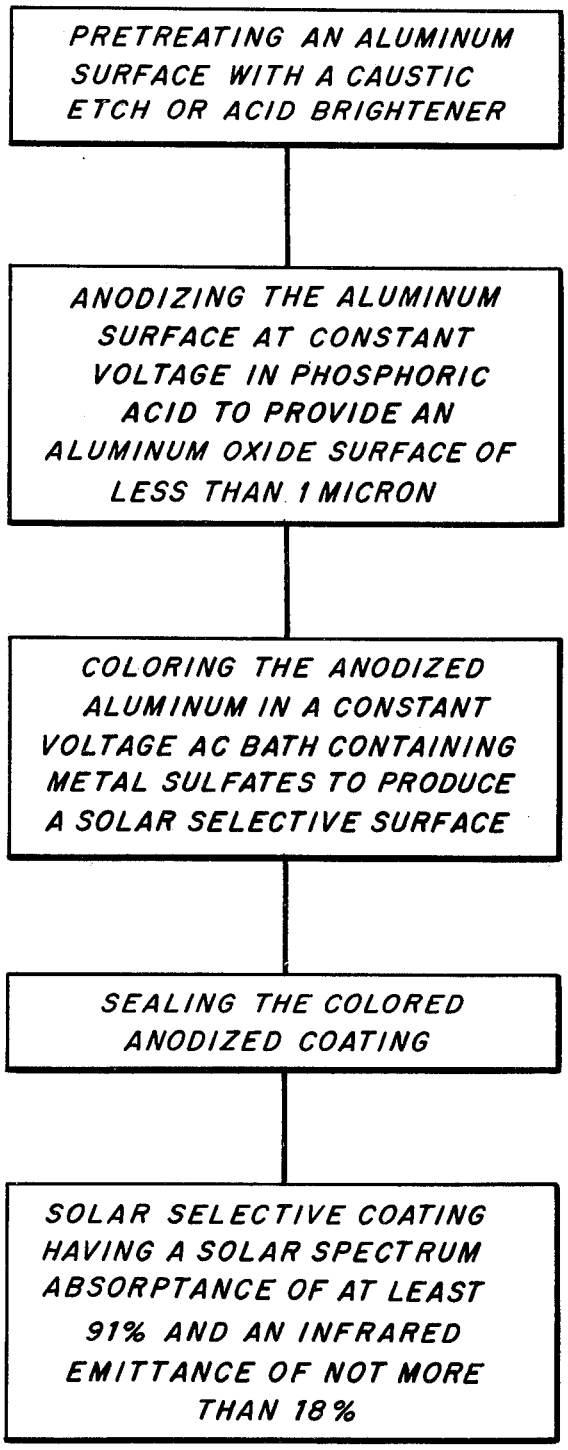

In accordance with the invention, a solar selective coating is applied to an aluminum surface using a constant voltage DC technique in a phosphoric acid bath to achieve an anodic coating thickness of 1 micron or less.

The aluminum material to which the solar selective coating is applied may comprise sheet, plate or forgings. Preferably, however, the surface is pretreated using well known etching or chemical brightening type pretreatments to ready the surface for the anodizing step.

One such pretreatment process is designated C22 (Aluminum Association) in which an aluminum surface is treated at 65° C. (150° F.) for 15 seconds with a caustic etch comprising 5% sodium hydroxide.

Another pretreatment which can be satisfactorily used is designated C31 (Aluminum Association) in which the aluminum surface is chemically brightened from 1 to 3 minutes from 87°–115° C. (189°–240° F.) in a 70–80% phosphoric-nitric acid such as described in U.S. Pat. No. 2,729,551, assigned to Colonial Alloys.

The pretreated aluminum is then anodized in a direct current (DC) bath at a constant voltage in the range of 10 to 20 volts. The anodization is carried out for a time period sufficient to provide a total current of 90 to 175 coulombs per square decimeter of aluminum surface. The constant anodizing voltage may be set sufficiently high to provide the total current flow in less than 10 minutes.

Using a constant voltage technique together with measurement of the cumulative current flow provides an accurate means for determining coating thickness which is a function of total current flow. Furthermore, the process lends itself to operation on a continuous basis which will be more economical for larger scale operations.

The anodizing bath consists of 5 to 15 wt.% phosphoric acid at a temperature of from 20° to 40° C., preferably 24° to 40° C. If the pretreatment is an acidic chemical brightening treatment, the strength of the phosphoric acid can be considerably reduced to as little as 2.5–5 wt.%. With caustic pretreatment, however, higher strength phosphoric acid of 10–15 wt.% is preferred.

Following the DC anodizing step, the anodized aluminum is subjected to an electrocoloring step using an alternating current (AC) in a bath containing metal salts. Such a process is disclosed in the aforementioned Asada U.S. Pat. No. 3,382,160. In the instant invention a bath containing at least 85 grams of metal sulfate per liter is used.

In a preferred embodiment, the metal salt comprises either a cobalt or nickel sulfate salt in combination with magnesium sulfate and boric acid and a concentration of at least 88 grams of metal salts per liter is used. When cobalt sulfate is used, a preferred formulation comprises 100 grams per liter of cobalt sulfate-heptahydrate, 40 grams per liter of boric acid, 10 grams per liter of tartaric acid and 175 grams per liter of magnesium sulfate heptahydrate.

When nickel sulfate is used, a preferred bath composition comprises 63.4 grams per liter of nickel sulfate hexahydrate, 20 grams per liter boric acid and 35 grams per liter of magnesium sulfate-heptahydrate.

In either formulation, the pH is maintained at 4.1–4.5 and the coloring process is carried out under constant voltage conditions of 8–12 volts RMS, preferably 10 volts, at room temperature for 3–12 minutes, preferably about 4 minutes when using nickel sulfate salts, and about 10 minutes when using cobalt sulfate.

The electrocolored anodized sheet is then sealed using techniques well known to those skilled in the art to seal the porous surface of the sheet produced during the anodizing and coloring process steps. While the sealing may be successfully carried out using a number of well known sealing techniques, care must be exercised in selecting sealing conditions which will not have an adverse effect on the solar spectrum absorptance or infrared emittance of the surface. Examples of successful sealing techniques which do not interfere with the solar selectivity of the coating include: a water seal for 10 minutes at 100° C.; sealing in an aqueous bath containing metal acetates for 10 minutes at 100° C. followed by a 2 minute desmutting treatment in 15% sulfuric acid at room temperature, as described in U.S. Pat. No. 3,791,940; sealing for 5 minutes in an aqueous bath containing 5 wt.% potassium dichromate at 100° C.; sealing for 5 minutes in an aqueous bath containing 5 vol.% Kasil No. 1 (potassium silicate) at 100° C.; or sealing at room temperature in an aqueous bath containing 0.25 vol.% Kasil No. 1 and without rinsing followed by drying at 90° C. for 5 minutes and curing at 250° C. for 5 minutes.

The following examples will serve to further illustrate the process of the invention.

EXAMPLE I

Small sample sheets of #13 reflector sheet, CC50 , 3004 and 5005 alloys were pretreated in a 5% sodium hydroxide caustic etch at 65° C. (150° F.) for 15 seconds. The sheets were then anodized in an 15% phosphoric acid electrolyte at room temperature at a constant DC voltage of 13 volts until a total current flow of 90 coulombs per square decimeter was reached. The anodized sheets were removed from the bath, rinsed in water and placed in an aqueous coloring bath containing 100 grams per liter of $CoSO_4.7H_2O$, 40 grams per liter of $H_3BO_3$, 10 grams per liter of $C_4H_6O_6$ and 175 grams per liter of $MgSO_4.7H_2O$. The pH was maintained in the range of 4.1 to 4.5. The AC coloring was carried out at 10 volts RMS until 300 coulombs per square decimeter of current was passed through the bath (about 10 minutes). The colored sheets were then removed from the bath, rinsed in deionized water and dried. The optical properties were then tested with a solar spectrum reflectometer and an emissometer, manufactured by Devices and Services Company, to determine the solar spectrum absorptance and the infrared emittance of the sheets. The absorptance was found to be 94±1% and the emittance was found to be 16±2%.

EXAMPLE II

The same type of samples as used in Example I were pretreated in a chemical brightener consisting of 70–80% phosphoric-nitric acid for 3 minutes at 99° C. (210° F.). The samples were then anodized and colored using the process described in Example I. The solar absorptance of these samples was found to be 94±2% and the corresponding emittance was 13±2%.

EXAMPLE III

Another set of samples the same as used in Example I were given the same caustic etch and anodizing as in Example I followed by an AC coloring step using nickel sulfate salt. The AC coloring bath contained 63.4 grams per liter $NiSO_4.6H_2O$, 20 grams per liter boric acid and 35 grams per liter $MgSO_4.7H_2O$. The pH was maintained in the range of 4.2–4.5, and the coloring was carried out at room temperature and at 10 volts RMS to a total current flow of about 100 coulombs per square decimeter which took about 4 minutes. The colored anodized sheets were then measured for solar absorptance and infrared emittance as in the previous examples. The solar absorptance was found to be 95% and the emittance was 14%. When the pretreatment was changed to acidic chemical brightening, as in Example II, and the remainder of the process duplicated as above, the sample sheets were found to have a solar absorptance of 94% and an emittance of 12%.

EXAMPLE IV

The same type of sets of samples as in the above examples were chemically brightened as in Example II and subsequently anodized in 5% phosphoric acid electrolyte at 30° C. at a constant voltage of 13 volts to obtain a total current flow of 156 coulombs per square decimeter of aluminum surface. The anodized sheet was further treated in an AC nickel sulfate coloring bath under the same conditions as in Example III. The resultant coating on tested sheets possessed an absorptance of 94% and an emittance of 16%.

While the process has been described and illustrated using batch techniques to verify the results, the greatest value and utility of the process lies in its adaptability to continuous processing using coils of aluminum sheet or plate in contrast to the slower prior art processes which do not use constant voltage techniques.

Using the process of the invention with the total current flows per square decimeter of aluminum surface and voltages disclosed, the process can be effectively made to run economically in a continuous manner by adjusting the speed of the coiled sheet through the bath and the length of the bath containers through which the coiled sheet passes.

While the invention has been described in terms of preferred embodiments, the claims appended hereto are intended to encompass other embodiments which fall within the spirit of the invention.

What is claimed is:

1. A process for the production of a solar selective coating on aluminum which comprises:
(a) pretreating the aluminum surface;
(b) anodizing the pretreated aluminum at a constant voltage of at least 10 volts in a phosphoric acid bath for a time period sufficient to provide a total anodizing current of from 90 to 175 coulombs per square decimeter of aluminum surface;
(c) coloring the anodized aluminum using alternating current in a coloring bath containing at least 85 grams per liter of metal sulfates at a constant voltage of from 8 to 12 volt RMS for a time sufficient to permit total current flow of from 100 to 325 coulombs per square decimeter; and
(d) sealing the colored anodized coating to provide a solar selective coating on aluminum of less than 1 micron thickness and having an infrared emittance of not more than 18% and a solar spectrum absorptance of at least 91%.

2. The process of claim 1 wherein the aluminum surface pretreatment comprises a caustic etch.

3. The process of claim 2 wherein said caustic etch comprising treatment with 5% sodium hydroxide for at least 15 seconds at an elevated temperature.

4. The process of claim 1 wherein the aluminum surface pretreatment comprises an acidic chemical brightening.

5. The process of claim 4 wherein said acidic chemical brightening pretreatment comprises treatment in a phosphoric-nitric acid bath from about 1–3 minutes at a temperature of from about 87° to 115° C.

6. The process of claim 1 wherein said constant anodizing voltage is from 10 to 20 volts DC.

7. The process of claim 6 wherein the constant anodizing voltage is set sufficiently high to provide the total current flow in less than 10 minutes.

8. The process of claim 1 wherein the phosphoric acid bath has a concentration of from 2.5 to 15 wt.%.

9. The process of claim 2 wherein the concentration of said phosphoric acid bath is from 10 to 15 wt.%.

10. The process of claim 4 wherein the concentration of said phosphoric acid bath is from 2.5 to 5 wt.%.

11. The process of claim 1 wherein the temperature of said anodizing bath is from 20°–40° C.

12. The process of claim 1 wherein the voltage in said coloring bath is coloring about 10 volts RMS.

13. The process of claim 12 wherein the coloring bath is maintained at room temperature.

14. The process of claim 13 wherein the coloring bath is maintained at a pH of from 4.1 to 4.5.

15. The process of claim 14 wherein the coloring bath comprises boric acid and sulfate salts of cobalt and magnesium.

16. The process of claim 15 wherein the coloring bath comprises boric acid and sulfate salts of nickel and magnesium.

17. A process for the production of a solar selective coating of less than 1 micron on an aluminum surface, said coating being further characterized by a solar spectrum absorptance of at least 91% and an infrared emittance of not more than 18%, said process comprising:
(a) pretreating the aluminum surface with an etch selected from the class consisting of caustic etches and acid etches;
(b) anodizing the etched aluminum surface at a constant voltage of from 10–20 volts DC in a 2.5 to 15 wt.% phosphoric acid bath at a temperature of from 20°–40° C. for a time sufficient to provide a total current flow of from 90–175 coulombs per square decimeter of aluminum surface;
(c) coloring the anodized aluminum using alternating current at a constant voltage of from 8–12 volts RMS in a coloring bath containing boric acid and at least 88 grams per liter of metal sulfates comprising magnesium sulfate and a second metal sulfate selected from the class consisting of cobalt sulfate and nickel sulfate at room temperature and a pH of from 4.1 to 4.5 for a time sufficient to provide a total current flow of from 100–325 coulombs per square decimeter of aluminum surface; and
(d) sealing the colored anodized aluminum surface with a sealing solution which will not interfere with the solar selectivity of the resultant coating.

18. A process for the production of a solar selective coating on an aluminum surface, said process being characterized by capability of operation on a continuous basis, and wherein the thickness of the coating may be accurately controlled by measurement of the cumulative current flow using constant voltage comprising:
(a) pretreating the aluminum surface with an etch selected from the class consisting of caustic etches and acid etches;
(b) anodizing the pretreated aluminum at a constant voltage of from 10 to 20 volts in a phosphoric acid bath for a time period sufficient to provide a total anodizing current of from 90 to 175 coulombs per square decimeter of aluminum surface;
(c) coloring the anodized aluminum using alternating current in a coloring bath containing at least 85 grams per liter of metal sulfates, said alternating current bath being maintained at a constant voltage of from 8 volts to 12 volts RMS for a time sufficient to permit total current flow of from 100 to 325 coulombs per square decimeter; and
(d) sealing the colored anodized coating with a sealant which will not interfere with the solar selectivity of the resultant coating;

whereby a solar selective coating will be formed on said aluminum surface characterized by a thickness of less than 1 micron, an infrared emittance of not more than 18%, and a solar spectrum absorptance of at least 91%.

19. The process of claim 18 wherein said phosphoric acid anodizing bath has a concentration of from 2.5 to 15 wt.% phosphoric acid.

20. The process of claim 19 wherein the temperature of said anodizing bath is from 20° to 40° C.

21. The process of claim 18 wherein said coloring bath also contains boric acid and the pH is maintained at from 4.1 to 4.5.

22. The process of claim 21 wherein said metal sulfates comprise magnesium sulfate.

* * * * *